US011712098B2

(12) United States Patent
Guerreiro et al.

(10) Patent No.: US 11,712,098 B2
(45) Date of Patent: Aug. 1, 2023

(54) HAND HELD APPLIANCE

(71) Applicant: Dyson Technology Limited, Wiltshire (GB)

(72) Inventors: Ilidio Silvestre Guerreiro, Bath (GB); Samuel William Saunders, Swindon (GB); Edward Sebert Maurice Shelton, Swindon (GB); Lolan Naicker, Gloucester (GB); Kyle James Crawford, Cirencester (GB)

(73) Assignee: Dyson Technology Limited, Malmesbury (GB)

( * ) Notice: Subject to any disclaimer, the term of this patent is extended or adjusted under 35 U.S.C. 154(b) by 1054 days.

(21) Appl. No.: 16/477,468

(22) PCT Filed: Jan. 11, 2018

(86) PCT No.: PCT/GB2018/050070
§ 371 (c)(1),
(2) Date: Jul. 11, 2019

(87) PCT Pub. No.: WO2018/130832
PCT Pub. Date: Jul. 19, 2018

(65) Prior Publication Data

US 2019/0357653 A1 Nov. 28, 2019

(30) Foreign Application Priority Data

Jan. 12, 2017 (WO) ..... PCT/GB2017/050079

(51) Int. Cl.
*A45D 20/12* (2006.01)
*H05B 3/14* (2006.01)
(Continued)

(52) U.S. Cl.
CPC ..... *A45D 20/12* (2013.01); *A45D 1/00* (2013.01); *A45D 2/001* (2013.01); *H05B 3/141* (2013.01);
(Continued)

(58) Field of Classification Search
None
See application file for complete search history.

(56) References Cited

U.S. PATENT DOCUMENTS 1,755,790 A 4/1930 Nevel
2,261,136 A 11/1941 Brown, Jr.
(Continued)

FOREIGN PATENT DOCUMENTS

CN 87201262 U 1/1988
CN 1152371 A 6/1997
(Continued)

OTHER PUBLICATIONS

Office Action received for Japanese Patent Application No. 2021-032303, dated May 17, 2022, 8 pages (4 pages of English Translation and 4 pages of Original Document).
(Continued)

*Primary Examiner* — Thor S Campbell
(74) *Attorney, Agent, or Firm* — Faegre Drinker Biddie & Reath LLP

(57) ABSTRACT

A heater including a ceramic heater element and ceramic heat sink whereby the ceramic heater element and the ceramic heat sink are both formed from a plurality of layers of tape cast ceramic material. The ceramic heater element may be generally planar and extends within a first plane. The ceramic heat sink may extend in a second plane which is orthogonal to the first plane. The ceramic heat sink may include a plurality of fins which may be discrete. The layers of the ceramic heater element may be orientated orthogonal
(Continued)

to the layers of the ceramic heat sink. The ceramic heater element may comprise a conductive track which may be surface mounted to a distal side of the ceramic heater element than the ceramic heat sink or embedded within the ceramic heater element.

15 Claims, 13 Drawing Sheets

(51) Int. Cl.
*A45D 1/00* (2006.01)
*A45D 2/00* (2006.01)
*A45D 20/30* (2006.01)

(52) U.S. Cl.
CPC ..... *A45D 20/30* (2013.01); *A45D 2001/004* (2013.01); *A45D 2020/128* (2013.01)

(56) References Cited

U.S. PATENT DOCUMENTS 2,261,137 A 11/1941 Brown, Jr.
2,298,250 A 10/1942 Brown, Jr.
2,578,305 A 12/1951 Huet
2,644,225 A 7/1953 Dietz
2,789,797 A 4/1957 Simpelaar
3,205,560 A 9/1965 Loehlein
3,266,661 A 8/1966 Dates
3,396,458 A 8/1968 Meng et al.
3,848,111 A 11/1974 Brouneus
4,286,377 A 9/1981 Hurko et al.
4,352,008 A 9/1982 Hoefer et al.
4,395,619 A 7/1983 Harigai
4,414,052 A 11/1983 Habata et al.
4,471,213 A 9/1984 Yoshida
4,558,209 A 12/1985 Hess
4,611,238 A 9/1986 Lewis et al.
4,715,430 A 12/1987 Arnold et al.
4,820,903 A 4/1989 Ishida
4,822,980 A 4/1989 Carbone et al.
4,866,248 A * 9/1989 Altamore ..... A45D 1/04 132/229
4,910,382 A 3/1990 Kakuya et al.
5,077,889 A 1/1992 Matsuda et al.
5,177,341 A 1/1993 Balderson
5,243,683 A 9/1993 Yang
5,753,893 A 5/1998 Noda et al.
6,089,314 A 7/2000 Becker et al.
6,735,082 B2 5/2004 Self
6,852,955 B1 2/2005 Golan et al.
7,082,032 B1 7/2006 Barsun et al.
7,335,855 B2 2/2008 von der Lühe et al.
7,355,148 B2 4/2008 Boussier
7,725,011 B2 5/2010 Boussier
8,051,896 B2 11/2011 Wayman
9,273,724 B1 3/2016 Rosenholm et al.
9,338,827 B2 5/2016 Braun et al.
2001/0001416 A1 5/2001 Lee et al.
2004/0139709 A1 7/2004 Illingworth et al.
2004/0244959 A1 12/2004 Chien et al.
2004/0256380 A1 12/2004 Wu
2006/0087398 A1 4/2006 Wu
2006/0289475 A1 12/2006 Tung et al.
2007/0033825 A1 2/2007 Lo et al.
2007/0114219 A1 5/2007 Rizzuto, Jr.
2007/0257022 A1 11/2007 Lin et al.
2008/0179314 A1 7/2008 Colja et al.
2009/0000143 A1 1/2009 Bazzicalupo et al.
2009/0178795 A1 7/2009 Wei
2009/0194519 A1 8/2009 Funaki et al.
2009/0293300 A1 12/2009 Merritt
2010/0035024 A1 2/2010 Datta et al.
2010/0111510 A1 5/2010 Lo
2011/0079378 A1 4/2011 Bajusz et al.
2011/0209721 A1 9/2011 Yahnker et al.
2011/0232673 A1* 9/2011 Crawford ..... A45D 1/04 132/232
2013/0087549 A1 4/2013 Wang
2014/0290087 A1 10/2014 Weatherly
2014/0290887 A1 10/2014 Gomi et al.
2014/0332023 A1* 11/2014 Kaizuka ..... A45D 2/002 132/118
2016/0220004 A1 8/2016 Moloney et al.
2016/0302548 A1 10/2016 Yamazaki
2016/0360850 A1 12/2016 Ngo
2017/0231353 A1* 8/2017 Romeo ..... A45D 2/38 132/211
2018/0271247 A1* 9/2018 Marston ..... A45D 1/16
2018/0328624 A1 11/2018 Naicker et al.
2019/0357653 A1* 11/2019 Guerreiro ..... A45D 20/12
2019/0380463 A1 12/2019 Guerreiro et al.
2020/0002828 A1* 1/2020 Mills ..... H01L 31/0735
2022/0287429 A1* 9/2022 Richmond ..... A45D 1/06

FOREIGN PATENT DOCUMENTS

CN 2314542 4/1999
CN 2345907 10/1999
CN 1278745 A 1/2001
CN 2509489 Y 9/2002
CN 2597867 Y 1/2004
CN 2609402 Y 4/2004
CN 27502043 1/2006
CN 2765509 Y 3/2006
CN 1882200 A 12/2006
CN 2917159 Y 6/2007
CN 101008287 A 8/2007
CN 201054804 4/2008
CN 101289328 10/2008
CN 101312603 A 11/2008
CN 101433126 A 5/2009
CN 201700020 U 1/2011
CN 102355758 2/2012
CN 102423184 4/2012
CN 102538547 A 7/2012
CN 102693888 A 9/2012
CN 202501554 U 10/2012
CN 102833896 12/2012
CN 102883483 A 1/2013
CN 103079339 A 5/2013
CN 202918516 U 5/2013
CN 103546998 1/2014
CN 203608982 U 5/2014
CN 103836595 6/2014
CN 104019486 A 9/2014
CN 204757782 U 11/2015
CN 204968132 U 1/2016
CN 105407757 A 3/2016
CN 205624989 U 10/2016
CN 205909491 U 1/2017
CN 106859485 A 3/2017
CN 106604422 A 4/2017
DE 2359478 6/1975
DE 2626409 12/1977
DE 2758078 2/1979
DE 3221868 A1 3/1983
DE 19637431 A1 3/1998
DE 10109734 9/2002
DE 102005026496 7/2006
DE 102008003975 7/2009
EP 0004145 A1 9/1979
EP 0053508 A1 6/1982
EP 0207677 1/1987
EP 0317902 A2 5/1989
EP 0368206 8/1994
EP 0942468 9/1999
EP 1070459 1/2001
EP 1819199 A1 8/2007
EP 1657993 4/2008
EP 2000042 12/2008
EP 3626113 B1 2/2021
ES 2217989 11/2004
FR 2142816 2/1973

(56) References Cited

FOREIGN PATENT DOCUMENTS

| | | | | |
|---|---|---|---|---|
| FR | 2784274 | | 4/2000 | |
| FR | 2848685 | | 6/2004 | |
| FR | 2855709 | | 12/2004 | |
| FR | 2862374 | | 5/2005 | |
| GB | 883547 | | 11/1961 | |
| GB | 1356753 | | 6/1974 | |
| GB | 1539485 | | 1/1979 | |
| GB | 1539485 | A | 1/1979 | |
| GB | 2261351 | | 5/1993 | |
| JP | 52-78838 | | 6/1977 | |
| JP | 52-081378 | U | 6/1977 | |
| JP | S55-23672 | U | 2/1980 | |
| JP | S55-55104 | U | 4/1980 | |
| JP | 57-120047 | | 7/1982 | |
| JP | 63-10563 | | 1/1988 | |
| JP | 2-10683 | | 1/1990 | |
| JP | 2-94384 | | 4/1990 | |
| JP | 2-153868 | | 6/1990 | |
| JP | 2-191303 | | 7/1990 | |
| JP | 3-182088 | | 8/1991 | |
| JP | 4-104493 | | 4/1992 | |
| JP | 4-348701 | | 12/1992 | |
| JP | H7-37095 | Y2 | 8/1995 | |
| JP | H9-213455 | A | 8/1997 | |
| JP | H10-160249 | A | 6/1998 | |
| JP | 10-209357 | A | 8/1998 | |
| JP | 2821749 | B2 | 11/1998 | |
| JP | 11-017080 | A | 1/1999 | |
| JP | 11-097156 | A | 4/1999 | |
| JP | 2001-60784 | | 3/2001 | |
| JP | 2003-068565 | A | 3/2003 | |
| JP | 3117518 | U | 1/2006 | |
| JP | 2015-097167 | A | 5/2015 | |
| JP | 2021-166822 | A | 10/2021 | |
| KR | 10-0503262 | | 7/2005 | |
| KR | 10-2012-0019911 | | 3/2012 | |
| KR | 10-2012-0071098 | A | 7/2012 | |
| KR | 2012-0091768 | A | 8/2012 | |
| KR | 10-2012-0113927 | | 10/2012 | |
| KR | 10-1277264 | B1 | 6/2013 | |
| KR | 10-2015-0000234 | | 1/2015 | |
| TW | M307926 | U | 3/2007 | |
| TW | M497245 | U | 3/2015 | |
| WO | 96/11372 | | 4/1996 | |
| WO | 99/22844 | A1 | 5/1999 | |
| WO | 2006/055946 | | 5/2006 | |
| WO | 2007/135644 | | 11/2007 | |
| WO | 2007/135773 | | 11/2007 | |
| WO | 2012/087021 | | 6/2012 | |
| WO | WO-2012087021 | A2 * | 6/2012 | ..... A45D 1/04 |
| WO | 2017/046559 | A1 | 3/2017 | |
| WO | 2018/130798 | A1 | 7/2018 | |
| WO | 2018/130832 | A1 | 7/2018 | |

OTHER PUBLICATIONS

Evaluation Report dated Feb. 5, 2019, directed to CN Application No. 2018206919738; 7 pages.

Examination Report dated Feb. 27, 2020, directed to GB Application No. 1707513.6; 3 pages.

Examination Report No. 1 for standard patent application dated May 15, 2020, directed to AU Application No. 2018265351; 7 pages.

First Office Action and Search Report received for Chinese Patent Application No. 201880006876.3, dated Aug. 31, 2021, 19 pages (11 pages of English Translation and 8 pages of Original Document).

Further Search Report dated Apr. 10, 2018, directed to GB Application No. 1707513.6; 2 pages.

International Search Report and Written Opinion dated Sep. 18, 2018, directed to PCT/GB2018/051028; 17 pages.

Notification of Reason for Refusal dated Dec. 3, 2020, directed to KR Application No. 10-2019-7021630; 10 pages.

Notification of Reason for Rejection dated Jul. 29, 2019, directed to JP Application No. 2018-091457; 6 pages.

Notification of Reason for Rejection dated Sep. 3, 2020, directed to JP Application No. 2019-537761; 7 pages.

Office Action dated Oct. 28, 2020, directed to JP Application No. 2019-233802; 4 pages.

Office Action received for Chinese Patent Application No. 201810441952.5, dated Jul. 28, 2021, 21 pages (13 pages of English Translation and 8 pages of Original Document).

Office Action received for European Application No. 18721112, dated Jul. 1, 2021, 6 pages.

Search Report dated Oct. 12, 2017, directed to GB Application No. 1707513.6; 2 pages.

The First Office Action dated Nov. 27, 2020, directed to CN Application No. 201880052111.3; 19 pages.

Written Opinion dated Nov. 12, 2020, directed to SG Application No. 11201909639Y; 7 pages.

Office Action received for Chinese Patent Application No. 201780083337.5, dated Aug. 2, 2022, 14 pages (8 pages of English Translation and 6 pages of Original Document).

Office Action received for European Patent Application No. 17701007.1, dated Aug. 11, 2022, 6 pages.

Office Action received for European Patent Application No. 18700391.8, dated Aug. 11, 2022, 6 pages.

Office Action received for Chinese Patent Application No. 201880006876.3, dated Jun. 15, 2022, 22 pages (13 pages of English Translation and 9 pages of Original Document).

Office Action received for Japanese Patent Application No. 2021-116982, dated Jun. 7, 2022, 10 pages (6 pages of English Translation and 4 pages of Original Document).

Office Action received for Chinese Patent Application No. 201780083337.5, dated Mar. 14, 2022, 18 pages (10 pages of English Translation and 8 pages of Original Document).

Office Action received for Chinese Patent Application No. 201810441952.5, dated Jan. 29, 2022, 19 pages (12 pages of English Translation and 7 pages of Original Document).

Naicker et al., U.S. Office Action dated Mar. 18, 2021, directed to U.S. Appl. No. 15/974,435; 11 pages.

Office Action received for Chinese Patent Application No. 201780083337.5, dated Oct. 8, 2022, 18 pages (10 pages of English Translation and 8 pages of Original Document).

Naicker et al., U.S. Office Action dated Oct. 14, 2020, directed to U.S. Appl. No. 15/974,435; 16 pages.

Naicker et al., U.S. Office Action dated Apr. 13, 2020, directed to U.S. Appl. No. 15/974,435; 12 pages.

Notice to Submit a Response dated Dec. 2, 2020, directed to KR Application No. 10-2019-7021605; 10 pages.

Notification of Reason for Rejection dated Sep. 3, 2020, directed to JP Application No. 2019-537810; 8 pages.

International Search Report and Written Opinion dated Aug. 30, 2017, directed to International Application No. PCT/GB2017/050079; 12 pages.

International Search Report and Written Opinion dated Jun. 11, 2018, directed to PCT/GB2018/050070; 16 pages.

* cited by examiner

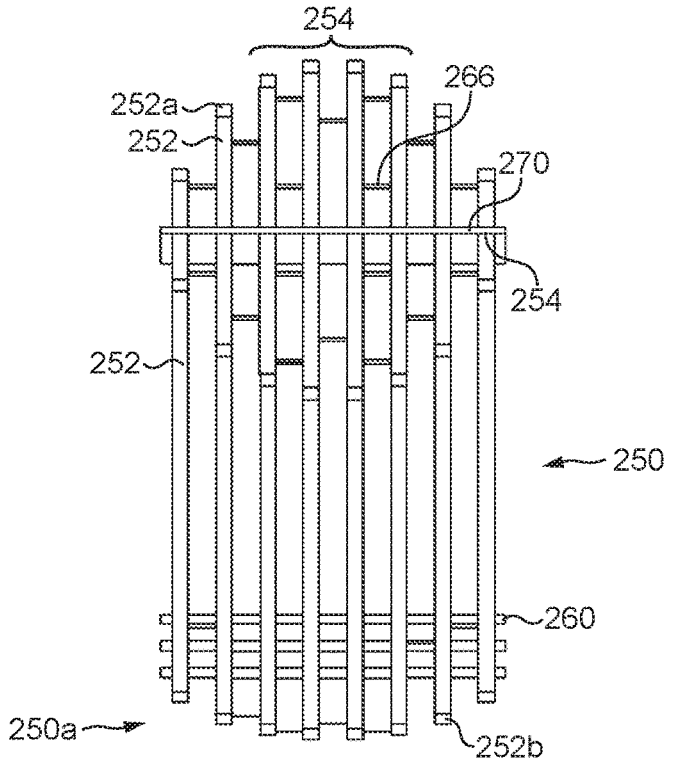
FIG. 9d
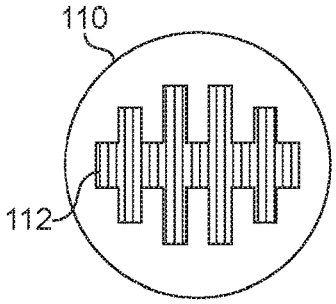
vs
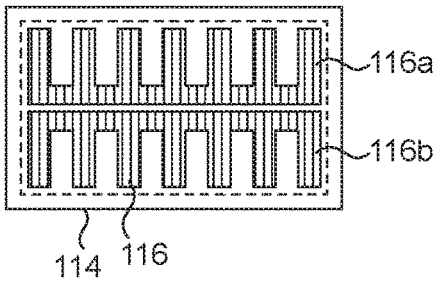
FIG. 10a
FIG. 10b
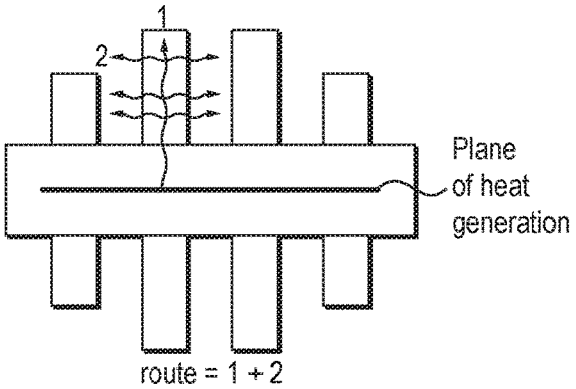
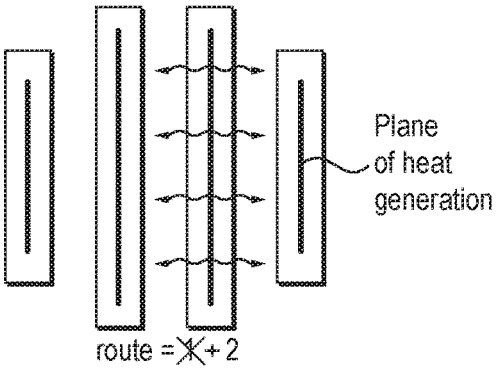
FIG. 11a
FIG. 11b Fully Parallel Fully Series Other vs vs

HAND HELD APPLIANCE

REFERENCE TO RELATED APPLICATIONS

This application is a national stage application under 35 USC 371 of International Application No. PCT/GB2018/050070, filed Jan. 11, 2018, which claims priority to International Application No. PCT/GB2017/050079, filed Jan. 12, 2017, the entire contents of each of which are incorporated herein by reference.

FIELD OF THE INVENTION

This invention relates to a hand held appliance, and in particular a hand held appliance having a heater.

BACKGROUND OF THE INVENTION

Hand held appliances such as hair care appliances and hot air blowers are known. Such appliances are provided with a heater to heat either fluid flowing through the appliance or a surface at which the appliance is directed. Most devices are either in the form of a pistol grip with a handle including switches and a body which houses components such as a fan unit and a heater. Another form is for a tubular housing such as found with hot styling devices. Thus, generally the option is to have fluid and/or heat blowing out of an end of a tubular housing and either to hold onto that housing or be provided with a handle orthogonal to the tubular housing.

This makes the appliance either bulky or sometimes difficult to use as the appliance can be long and/or heavy. A solution to this is two provide a curved form as this reduces the length and can remove some of the bulk. It is known to have a curved hair care appliance with a curved section and then to provide a fan unit in a straight section on one side and the heater in a straight section on the other side. This has the problem that in the curved section fluid can become turbulent resulting in pressure losses and the production of noise. This could be mitigated by turning vanes in the curved section but that adds weight and cost to the appliance. Thus, the inventors have combined the use of a curved hairdryer with the use of a curved ceramic heater so features of the heater can be used to turn and direct the fluid flowing through the curved section and heat this fluid at the same time. This makes the design smaller, quieter and the fluid flowing from the outlet of the appliance can be engineered to exit at any convenient angle regardless of the location of the fluid inlet.

SUMMARY OF THE INVENTION

According to some embodiments, a hand held appliance comprises a fluid flow path extending between a fluid inlet and a fluid outlet and a ceramic heater within the fluid flow path wherein the fluid flow path is non-linear and the heater is non-linear.

Preferably, the appliance further comprises a housing wherein the housing houses the heater and encloses the fluid flow path, and wherein the housing is curved. In a preferred embodiment the heater is curved.

According to some embodiments, a hand held appliance comprises a housing, a fluid flow path extending between a fluid inlet and a fluid outlet and a ceramic heater within the fluid flow path wherein the housing houses the heater and encloses the fluid flow path, and wherein the housing is curved and the heater is curved.

Preferably, the housing comprises a straight section and a curved section and the heater is housed within the curved section. Preferably, the heating element is arcuate. In a preferred embodiment the heater comprises at least one heating element comprising a flat ceramic plate and a conductive track. According to some embodiments, a housing is provided, a fluid flow path extending between a fluid inlet and a fluid outlet and a ceramic heater within the fluid flow path wherein the housing houses the heater and encloses the fluid flow path, and wherein the housing is curved and the heater is curved. In a preferred embodiment the heating element has a constant curvature. Preferably, the heating element curves around an angle of 10° to 170°. In a preferred embodiment the heating element curves around an angle of 80° to 120°.

In a preferred embodiment the heater comprises a heating element and a plurality of fins extending away from the heating element wherein, the plurality of fins dissipate heat from the heating element into the fluid flow path.

Preferably, the heating element is an arcuate flat plate and the plurality of fins extend away from the heating element and are also arcuate. Thus, the heating element is arcuate or curved in one plane and flat in another plane. For example, the heating element is planar in the XY plane and curved in the XZ plane. The fins are orientated orthogonal to the flat plate in the XZ plane. Preferably, the fins follow the same curve as the heating element. In a preferred embodiment each one of the plurality of fins follows the same angle of curvature as the heating element.

Preferably, the heater comprises a heating element and a plurality of fins extending away from the heating element wherein, the plurality of fins direct flow of fluid flowing within the heater.

In a preferred embodiment, the plurality of fins comprise a channel extending between adjacent pairs of the plurality of fins and wherein each channel directs flow through the heater.

Preferably, each channel is defined by a surface of a pair of adjacent fins and a portion of a surface of the heating element and wherein, each channel dissipated thermal energy from the heating element into fluid flowing within the fluid flow path.

In a preferred embodiment the housing comprises a straight portion and a curved portion. Preferably, within the straight portion, the housing houses a fan unit. In a preferred embodiment, within the straight portion the housing comprises a handle.

In a first aspect, a heater comprises a ceramic heater element and ceramic heat sink whereby the ceramic heater element and the ceramic heat sink are both formed from a plurality of layers of tape cast ceramic material.

Preferably, the ceramic heater element is generally planar and extends within a first plane. It is preferred that the ceramic heat sink comprises a plurality of fins. Preferably each one of the plurality of fins is discrete. It is preferred that the ceramic heat sink extends in a second plane which is orthogonal to the first plane.

Preferably, the layers of the ceramic heater element are orientated orthogonal to the layers of the ceramic heat sink.

In a preferred embodiment, the ceramic heater element comprises a conductive track. In one embodiment, the conductive track is surface mounted to a distal side of the ceramic heater element from the ceramic heat sink. Preferably, the conductive track is coated with an insulating material such as a glaze. Alternatively, the conductive track is embedded within the ceramic heater element.

Preferably, the ceramic heat sink is bonded to a surface of the ceramic heater element. Alternatively, the ceramic heater sink is partially embedded in the ceramic heater element. In this embodiment, the ceramic heater element is provided with a series of grooves or channels for at least partially accommodating the ceramic heat sink.

The ceramic heater element is planar but may be any shape within that plane. Examples include curved or arcuate and rectangular. For a quadrilateral shape the ceramic heat sink is generally planar. However, for a curved or arcuate form, the ceramic heat sink follows the same arc as the ceramic heater element. As the ceramic heat sink is attached to the ceramic heater element in the green state, it can be bent to shape and then attached to the ceramic heater element.

In a second aspect, a method of manufacturing a ceramic heater having a ceramic heating element and a ceramic heat sink comprises the steps of:

(a) tape casting a plurality of layers of a ceramic material and stacking the layers to form a green state ceramic plate;

(b) applying a conductive track to a first surface of the green state ceramic plate;

(c) bonding a ceramic heat sink to a second surface of the green state ceramic plate; and (d) sintering the green state heater.

Preferably, the method includes the step of tape casting a second plurality of layers of a ceramic material and stacking the layers over the conductive track between steps (b) and (c). This forms an embedded conductive track. In this embodiment, the second surface of the green state ceramic plate is formed from the second plurality of layers.

Preferably, the ceramic heat sink is formed from a plurality of layers of tape cast ceramic material. It is preferred that the layers forming the ceramic heat sink are rotated by 90° prior to being bonded to the second surface of the ceramic heater element. Thus, the layers of the tape cast material are rotated by 90° i.e. the layers of the ceramic heat sink are orientated at 90° to the layers of the ceramic hearer element. Preferably, the ceramic heater element is generally planar and extends within a first plane. It is preferred that the ceramic heat sink extends in a second plane which is orthogonal to the first plane. Preferably, the ceramic heater element is generally planar and extends within a first plane and wherein the layers forming the ceramic heat sink are rotated about the first plane by 90° prior to being bonded to the second surface of the ceramic heater element.

Preferably, the number of layers in the green ceramic plate (the plurality of layers and the second plurality of layers if applicable) is similar to the number of layers in the ceramic heat sink. This means that the shrinkage of the two parts during sintering will be similar.

In one embodiment, the ceramic heat sink is bonded to the ceramic heater plate by applying a solvent at an interface between the ceramic heater element and the ceramic heat sink. The method additionally includes the step of curing the green state heater prior to sintering. This allows time for the joint to harden sufficiently to be moved without distortion. Preferably the curing time is one hour at room temperature. The time is dependent on the thickness of the parts of the joint.

In a third aspect, a heater comprises a plurality of heater elements and a frame wherein the frame supports and isolates each of the plurality of heater elements.

In this embodiment, the plurality of heater elements can be manufactured from a substrate of metal such as stainless steel or a ceramic. The conductive track can be surface mounted and then covered in a glaze or, for the ceramic version, the conductive track is embedded within the layers of the ceramic material. The substrate material is relatively thin 0.5-2.5 mm so having a surface mounted conductive track does not prevent heat from being dissipated from both sides of the heater element.

Preferably, the heater elements are planar in one direction and, as previously described, may be planar or arcuate in a second direction or plane.

Preferably, the frame comprises a plurality of brackets; one for each of the plurality of heater elements. The brackets constrain the heater elements maintaining a space between each adjacent pairs of heater elements.

In a preferred embodiment, the heater has a first end and a second end and the plurality of heater elements extend from the first end to the second end. Preferably, the frame comprises a pair of brackets for each one of the plurality of heater elements. Preferably, one bracket is disposed adjacent the first end and a second bracket is disposed adjacent the second end of the heater.

Preferably, each of the plurality of heater elements define a first edge and a second edge which extend between the first end and the second end of the heater. It is preferred that the frame is disposed along the first edge. In a preferred embodiment, a second frame is provided. Preferably, the second frame extends along the second edge of the heater. Preferably, the second frame comprises a plurality of brackets; one for each of the plurality of heater elements. Preferably, the second frame comprises a pair of brackets for each one of the plurality of heater elements. Preferably, one bracket is disposed adjacent the first end and a second bracket is disposed adjacent the second end of the heater.

Alternatively or additionally, a central frame is provided. The central frame extends from the first end to the second end of the heater and is disposed between the first edge and the second edge. Preferable, the central frame is formed from a stamped metal sheet and comprises an aperture sized for each one of the plurality of heater elements.

Preferably, the heater further comprises a flow guide for guiding the flow of fluid through the heater.

In a preferred embodiment, the heater is curved and the flow guide follows the angle of curvature of the heater. In a preferred embodiment, the heater has a first end and a second end and the plurality of heater elements extend from the first end to the second end. Preferably, each of the plurality of heater elements define a first edge and a second edge which extend between the first end and the second end of the heater. It is preferred that a first flow guide is provided adjacent a first edge. Preferably, a second flow guide is provided adjacent a second edge.

In a preferred embodiment, the first and/or the second flow guide has a plurality of guide portions and each of the guide portions extends along the heater between a pair of adjacent heater elements.

In one embodiment, the frame comprises both retaining brackets and the flow guides.

Preferably, the frame is formed from stamped metal.

In one embodiment each one of the plurality of heater elements are the same size. Alternatively, the plurality of heating elements encompass a range of sizes for example to provide a heater with a circular cross section.

Also disclosed is a hand held appliance that comprises a heater comprising a ceramic heater element and ceramic heat sink whereby the ceramic heater element and the ceramic heat sink are both formed from a plurality of layers of tape cast ceramic material.

Also disclosed, is a heater comprising a ceramic heater element and at least one heat sink for dissipating heat from the ceramic heater element wherein the ceramic heater element extends along a plane in one dimension and the at least one heat sink extends away from the plane, and wherein the at least one heat sink is ultrasonically welded to the ceramic heater element via discrete connecting portions.

Having discrete connecting portions means that the fin is not connected along its' entire length; there are gaps or breaks in the connection. These gaps enable the stress between the fin and the heater element to be relieved. When the heater is at high temperature or transitioning to or from ambient temperature, the fin material will expand or contract more than the heater element. The gaps or breaks enable the fin material to expand and deform somewhat without causing excessive stress to the heater element. In other words for a given temperature rise, the stress between the heater element and fins is reduced when such gaps are introduced.

Preferably, the discrete connecting portions are a plurality of substantially similar areas of contact between the ceramic heater element and the at least two fins. This uniformity is beneficial as without it, the thermal mis-match would vary along the length of the fin at its 'interface with the heating element causing certain areas to be more prone to cracking and/or debonding.

In a preferred embodiment, the discrete connecting portions are each separated by a similar sized gap and distance between gaps (gap frequency). Again this uniformity is beneficial for a uniform shaped heater as without it, the thermal mis-match would vary along the length of the fin causing certain areas to be more prone to cracking and/or debonding. Alternatively, for a non-uniform heater for example a curved heater, different gap sizes and gap frequency can be applied in adjacent regions of the heater to deliver appropriate stress relieve dependent on operating temperature.

Preferably, there are a plurality of heat sinks. In a preferred embodiment, the ceramic heater element is planar and the plurality of heat sinks extend orthogonally from a planar surface of the ceramic heater element. Preferably, the plurality of heat sinks additionally extend orthogonally from a second planar surface of the ceramic heater element.

Also disclosed is a method of manufacturing a ceramic heater having a ceramic heating element and a heat sink comprising the steps of:

(a) producing a green state ceramic plate;

(b) applying a conductive track to a first surface of the green state ceramic plate;

(c) sintering the green state ceramic plate; and (d) ultrasonically welding a heat sink onto a second surface of the sintered ceramic plate.

Preferably, the method includes the step of applying ceramic material over the conductive track between steps (b) and (c). This forms an embedded conductive track. Preferably, for an embedded track, a heat sink is ultrasonically welded onto the other surface of the of the sintered ceramic plate.

The green state ceramic plate can be formed from staking a plurality of layers of tape cast material, an extruded block of material or a moulded block.

Preferably, the appliance is a hair care appliance. It is preferred that the appliance is a hair dryer.

BRIEF DESCRIPTION OF THE DRAWINGS

The invention will now be described with reference to the accompanying drawings, of which:

FIG. 9*d* shows and end view of the heater of FIG. 9*c;*

FIG. 10*a* shows a cross section thorough a circular heater;

FIG. 10*b* shows a cross section through a quadrilateral heater;

FIG. 11*a* shows the heat dissipation route from a unified heater;

FIG. 11*b* shows the heat dissipation route from a stacked heater;

DETAILED DESCRIPTION OF THE INVENTION

Figure 1:
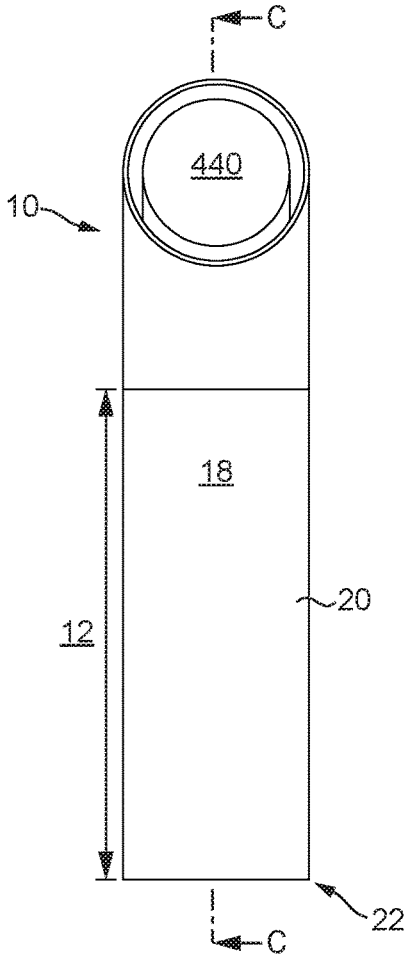
FIG. 1 shows a front view of an appliance according to aspects of the invention.
Figure 2:
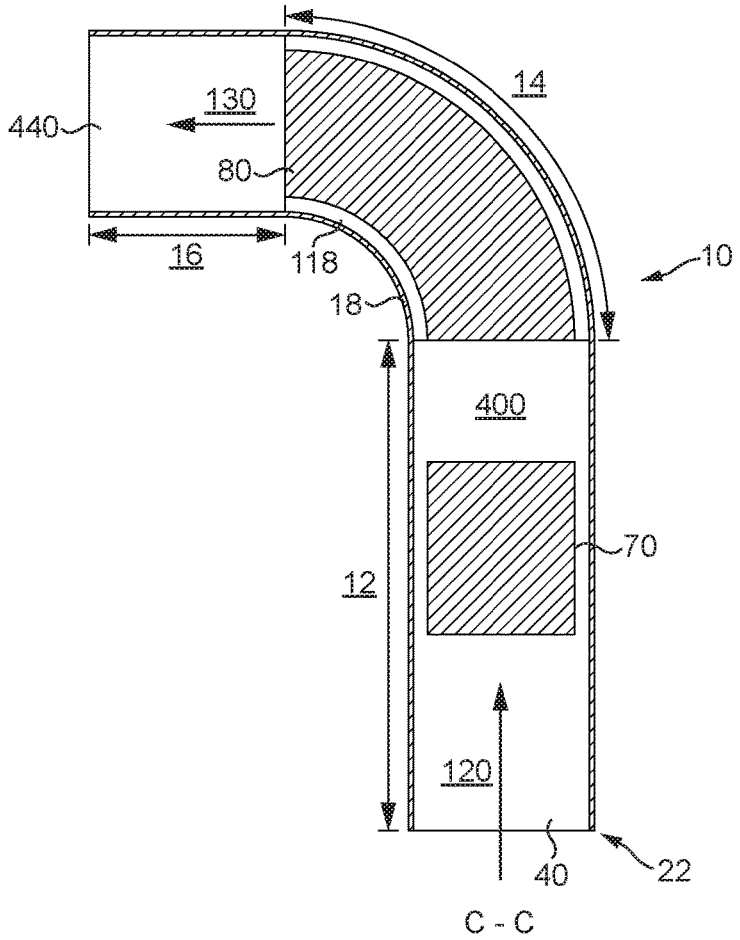
FIG. 2 shows a cross section along line C-C through the appliance of FIG. 1.
Figure 3:
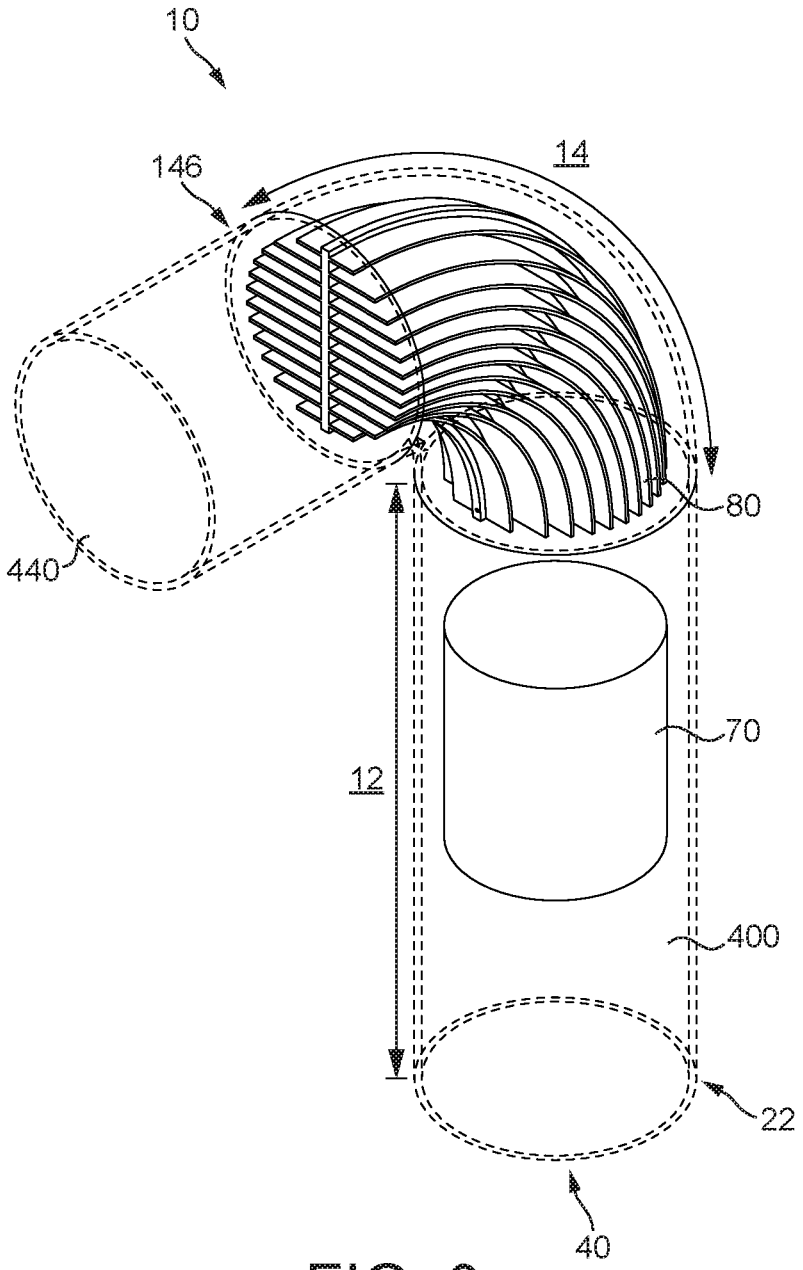
FIG. 3 shows schematically an isometric view of the appliance of FIG. 1.

FIGS. 1, 2, and 3 show an appliance, in this case a hairdryer 10 having a curved outer profile formed from an outer casing 18 of the appliance 10. There a straight section 12 which includes a handle 20 and a fan unit 70 and a curved section 14 which includes a heater 80. A fluid flow path 400 is provided through the appliance from a fluid inlet 40 which is provided at a first end 22 of the straight section 12 to a fluid outlet 440. The fluid outlet 440 is provided adjacent or downstream of the distal end 14*b* of the curved section 14 from the straight section 12. In this embodiment, there is a second straight section 16 provided downstream of the heater 80 or between the curved section 14 and the fluid outlet 440.

The fluid flow path 400 is non-linear and flows through the straight section 12 and the handle 20 in a first direction 120 and exits from the curved section 14 in a second direction 130. At the fluid outlet 440, the fluid flow path 400 has turned 90°, thus the first direction 120 is orthogonal to the second direction 130. However, this is just one example, different degrees of curvature can be used.

The hairdryer 10 can be considered to have an inlet plane extending across the first end 22 of the straight section 12 and an outlet plane extending across the fluid outlet 440 and the inlet plane and the outlet plane are non-parallel.

Figure 4A:
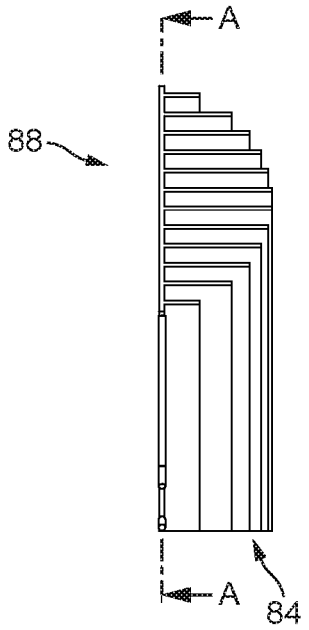
FIG. 4*a* shows a front view of part of a heater according to aspects of the invention.
Figure 4B:
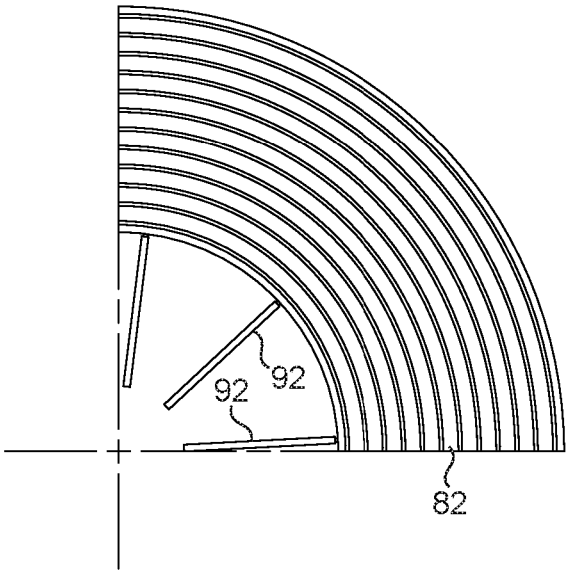
FIG. 4*b* shows a side view of the heater of FIG. 4*a;*
Figure 4C:
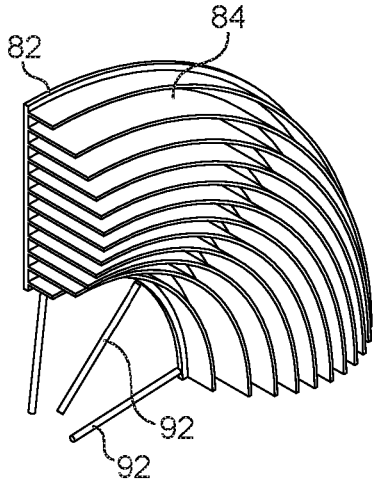
FIG. 4*c* shows an isometric view of the heater of FIG. 4*a;*
Figure 4D:
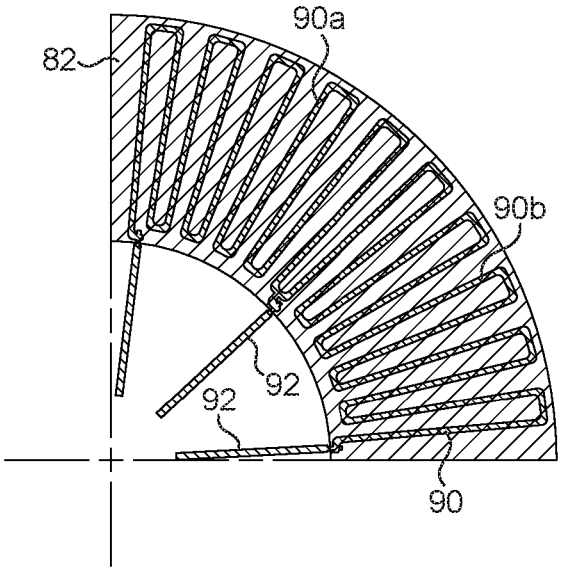
FIG. 4*d* shows a cross section along line A-A of FIG. 4*a;*

Referring now to FIGS. 4*a* to 4*d*, the heater 80 will be described in more detail. The heater 80 comes in two parts which are subsequently bonded together. FIGS. 4*a* to 4*c* show one of the two parts. The other of the two parts tends to be a mirror image of the one shown. The heater 80 comprises a heating element 88 formed from a flat ceramic plate 82 such as aluminium nitride which has a conductive track 90 typically screen printed onto the flat ceramic plate 82 when in its' green state. The flat ceramic plate 82 is formed by stacking a number of layers of tape cast ceramic material until the required thickness is achieved and then laminating the stack layers. The lamination process comprises vacuum sealing the stack in a plastic bag and hydrostatically pressing the stack to form the flat ceramic plate 82. Heat is dissipated from the conductive track 90 via a heat sink which typically comprises a plurality of fins 84 which extend out from the flat ceramic plate 82 and into the fluid flow path 400. The conductive track 90 is electrically connected to a power source (not shown) via heater connection leads 92. In this example the heater includes two heater tracks 90*a* and 90*b* and there are three leads 92 as the two heater tracks 90*a* and 90*b* share either the live or the neutral connection.

Once the conductive track has been screen printed onto the flat ceramic plate, it can either be covered by an insulating material such as a glaze or further layers of tape cast ceramic material can be stacked over the conductive track 90 embedding the conductive track 90 within the ceramic.

The heater 80, is a single sided unified heater and there are a few ways of manufacturing them. In one example, the heating element 88 can be fired and then sintered fins 84 can be bonded to the sintered heating element 88 using a bonding paste such as a glass bonding paste. Alternatively, the fins 84 can be attached to the flat ceramic plate 82 in the green state and they can be co-fired as a single unit. Co-firing provides a stronger joint and two methods will be discussed. The first produces the heater 80 of FIGS. 4*a* to 4*d*. In this embodiment, the fins 84 are surface mounted to the flat ceramic plate 82. The fins 84 can be pressed into contact with the surface of the flat ceramic plate 82. A bonding paste such as a glass bonding paste can be applied to the joint or a solvent is applied to the end of each fin 84 before it is attached to the flat ceramic plate 82 both of these options can be used with the pressed contact or without. The solvent dissolves binders in the tape cast material locally and after around an hour (depending on the thickness of the joints) the material re-cures with the fins 64 bonded to the flat ceramic plate 82.

A second method for producing a heater 50 will be described with reference to FIGS. 5*a* to 5*d*. The flat ceramic plate 52 has a first side 54 and a second side 56. The fins 60 will be attached to the first side 54 following preparation work. The stacked layers of tape cast ceramic material are laminated, then grooves 58 are milled into the flat ceramic plate 52 by, for example CNC milling of the stack after lamination.

The conductive track 90 is either surface mounted to the second surface 56 or is embedded within the flat ceramic plate 52. For the embedded embodiment, the flat ceramic plate 50 will need to be thicker than for the surface mounted option surface so the fins 60 which are recessed into the flat ceramic plate 52 are spaced from the conductive track 90.

The fins 60 are made from laminated sheets of ALN tape, which are green cut into appropriately sized rectangular pieces. Each of these pieces is planar upon cutting, but as the laminate is flexible in the green state, these pieces can be easily bent into a curved shape if required.

A solvent 64 such as Diethylene Glycol Mono-ethyl Ether Acetate (DGMEA) is painted into the grooves 56 and onto and end face 62 of the fins 60 using a paint brush. DGMEA acts like a glue. This chemical locally dissolves the laminate and allows the material (binder, ceramic, etc.) to flow to fill gaps between adjacent parts. As the dissolved material re-cures in around an hour (depending on the thickness of the fins amongst other things), a green-state joint is created.

Figure 6:
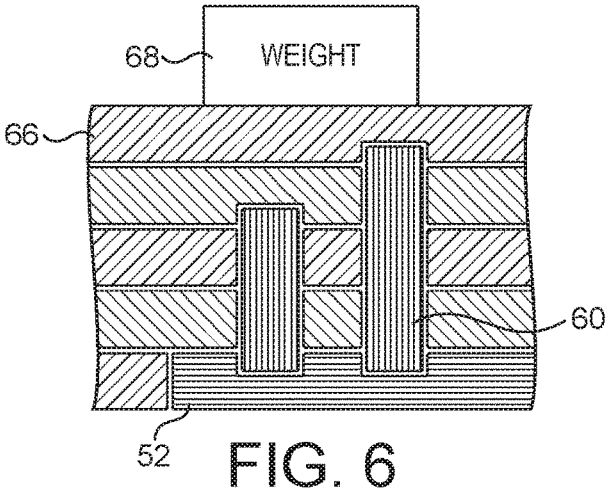
FIG. 6 shows an example of a jig for housing a heater during re-curing.
Figure 7A:
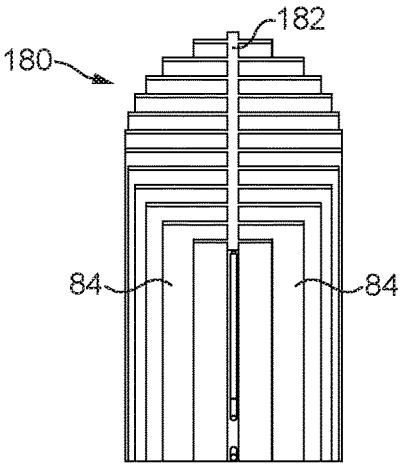
FIG. 7*a* shows a front view of part of another heater according to aspects of the invention.
Figure 7B:
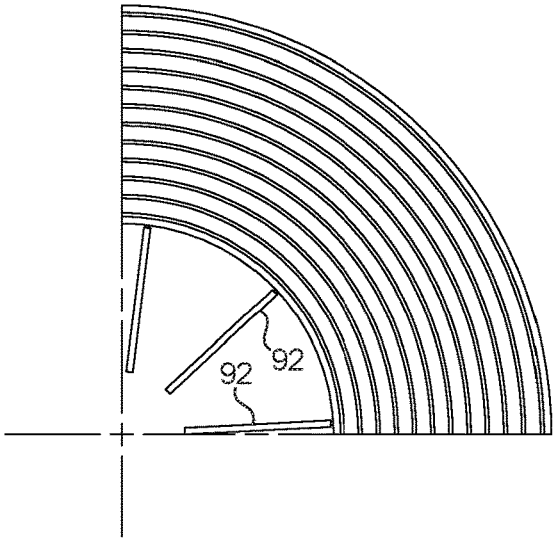
FIG. 7*b* shows a side view of the heater of FIG. 7*a;*
Figure 7C:
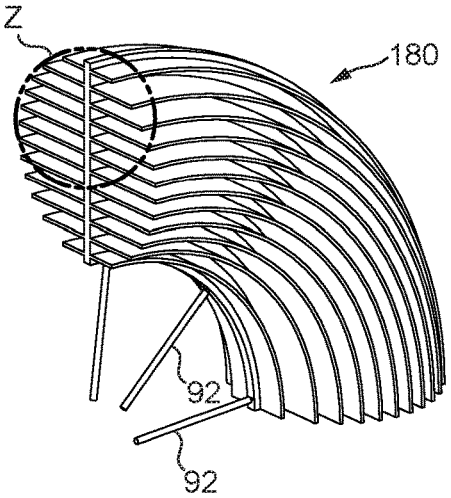
FIG. 7*c* shows an isometric view of the heater of FIG. 7*a;*
Figure 7D:
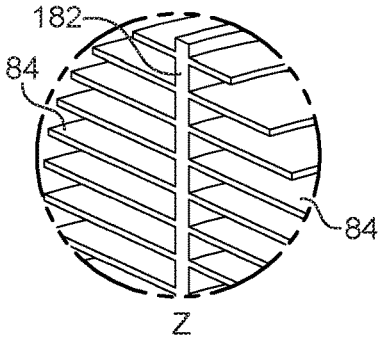
FIG. 7*d* shows an enlarged view of portion Z of FIG. 7*c;*

Regardless of the method used to produce the green state heater 50, 80 it is advantageous to support the green state heater 50, 80 during the re-curing process; an example of a jig is shown in FIG. 6. Sheets 66 of metal, for example aluminium are cut to fit around and between the fins and once the whole heater has been encapsulated, a weight 68 is added to press the joint together and ensure a good bond. The green state heater is then sintered to produce a single unified part.

Figure 5A:
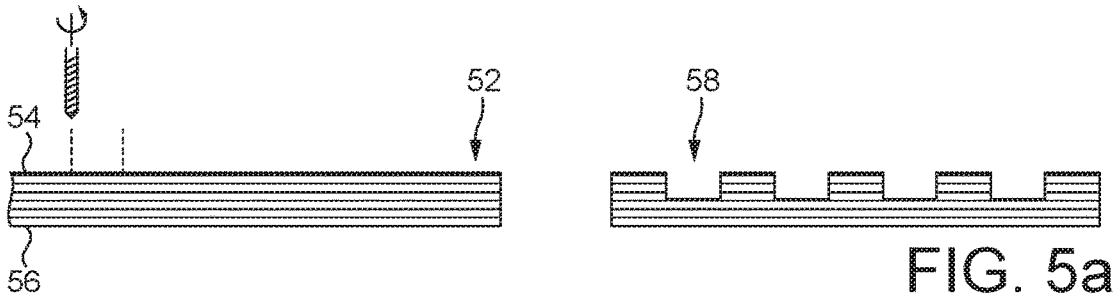
FIGS. 5*a* to 5*d* show schematically steps of a method of joining a heat sink to a heater element.
Figure 5B:
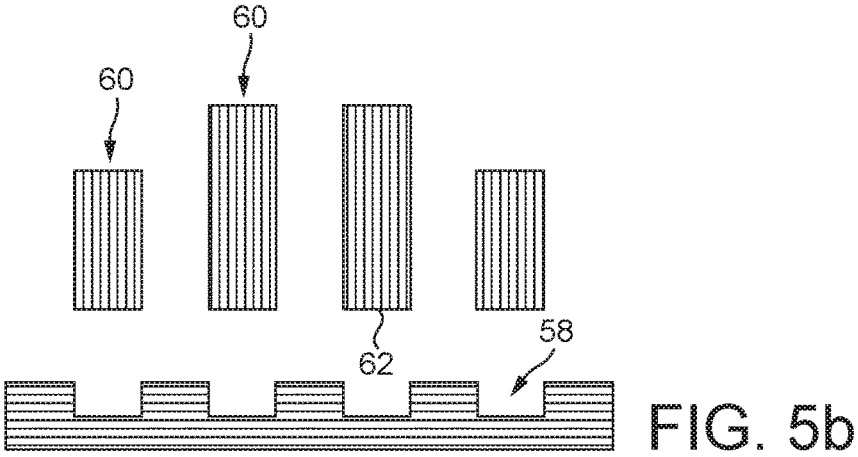
Figure 5C:
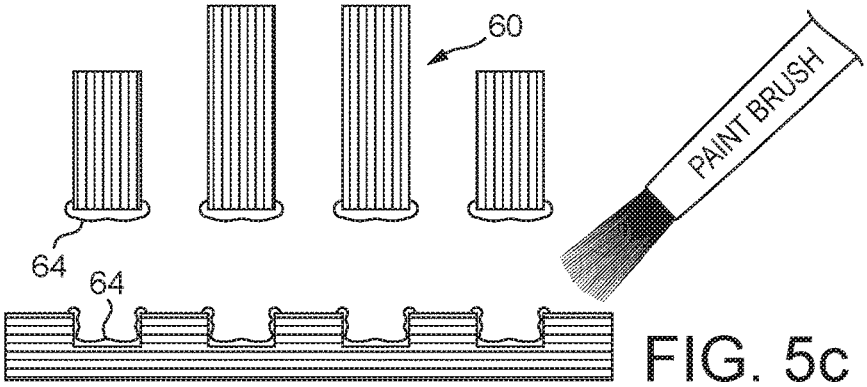
Figure 5D:
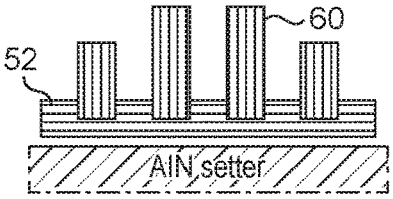
Figure 5E:
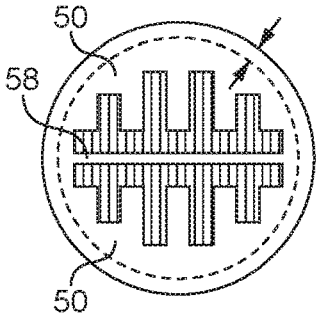
FIG. 5*e* shows two heaters joined together.

A single heater 50 can be used if this suits the situation, otherwise, after sintering, two heaters 50 are placed back to back and pressed together, or joined using a glaze, glue or a thermal paste 58 (FIG. 5*e*).

In this embodiment, the heater 50 is semi-circular in cross-section with the centrally located fins being longer than outer the fins; this is because in the example appliance 10, the heater 80 fits within a tube, alternatives are to have a square or rectangular heater.

FIGS. 7*a* to 7*d*, show another heater variation, 180. This heater is formed as a double sided heater 180. In this example the conductive track 90 is embedded in a flat ceramic plate 182 which has fins 84 attached to both sides. This eliminates the need for a bond between the two parts of the heater 80 described with respect to FIGS. 4*a* to 4*d*. There are a number of embodiments, the flat ceramic plate 182 can be fired and then sintered fins 84 subsequently attached using a bonding paste. Alternatively, all the fins 84 can be attached to the flat ceramic plate 182 in the green state as described earlier, either by surface bonding or by embedding the end of the fins 84 into the flat ceramic plate 182 and the whole heater 90 fired to produce the final article.

In this example, as the heater has a circular cross-section and is curved, the heater will either need to be self-supporting or will require supporting whilst being sintered. Conventionally, a piece of the same material is used to support the heater during the sintering process as this will shrink by the same amount during sintering. A person skilled in the art will appreciate this.

It is possible to make a fin from a single sheet of MN rather than a laminated stack of sheets. However, a thicker fin makes it easier to assemble the heater in the green state, and is more structurally robust once the heater is sintered and has better heat conduction up the fin (higher fin efficiency).

Green cutting of the parts, either to form the fins, the layers for the stacked ceramic heater element or to form the grooves to embed the fins in the flat ceramic plate can be through CNC milling, stamping using an appropriately shaped cutter tool, or a guillotine.

The heaters described with respect to FIG. 4*a* to FIG. 7*d* all show curved heaters with circular cross sections. FIGS. 10*a* and 10*b* show a cross section through a circular and a quadrilateral heater respectively. The curved heaters of FIG. 4*a* to FIG. 7*d* could alternatively be cylindrical heaters having a cross section as shown in FIG. 10*a* which shows a housing 110 which surrounds a heater 112. Equally, the heater could be a quadrilateral heater, such as a rectangular heater 116 surrounded by a housing 114 shown in FIG. 10*b*. Heater 112 is a unified heater, where the ceramic heater element and the fins are co-fired and heater 116 is formed from two single sided unified heaters 116*a*, 116*b* which are bonded as previously described after sintering.

Figure 8A:
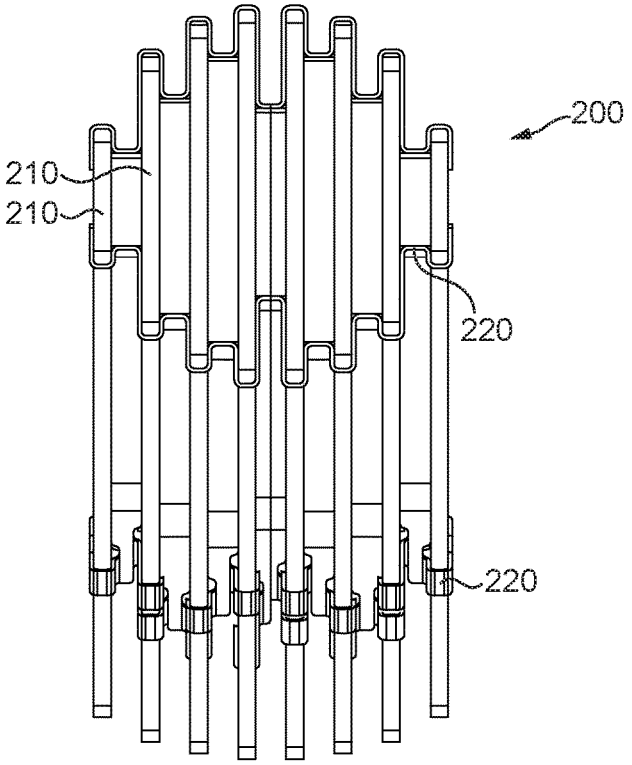
FIG. 8*a* shows a front view of part of another heater according to aspects of the invention.
Figure 8B:
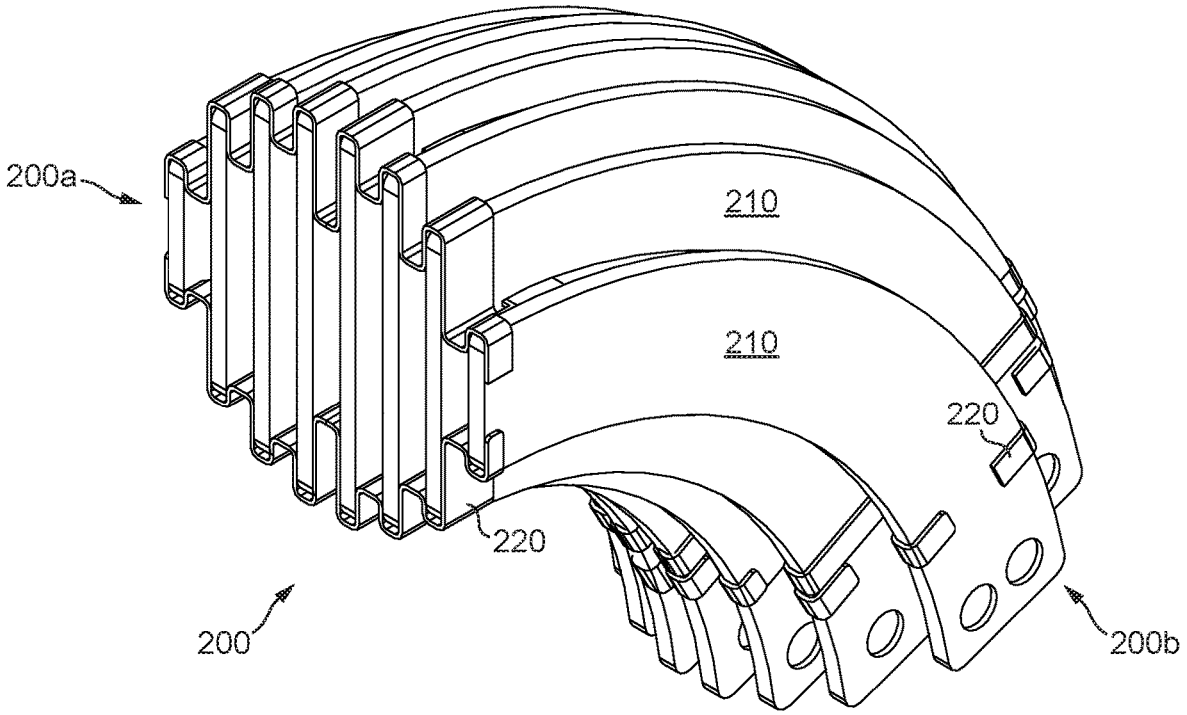
FIG. 8*b* shows an isometric view of the heater of FIG. 8*a;*
Figure 8C:
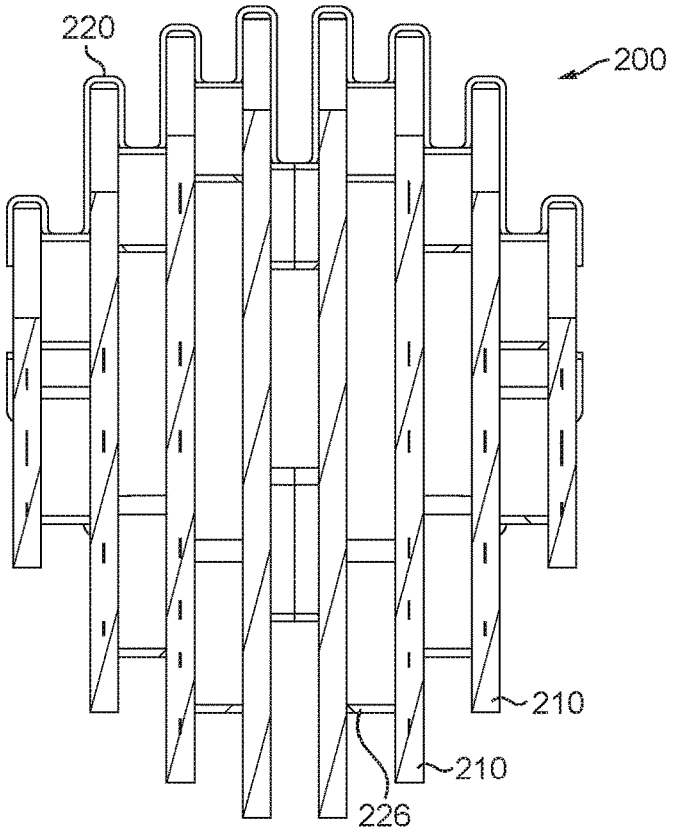
FIG. 8*c* shows a cross section along line G-G through the appliance of FIG. 8*a;*

FIGS. 8*a* to 8*c* show another heater 200. In this embodiment, a multitude of discrete flat ceramic plates 210 are used to provide the heat. As previously described, each of the discrete ceramic plates 210 includes a conductive track (not shown) and in this embodiment are held together with a scaffold formed from stamped metal sheets 220. The flat ceramic plates 210 are held at or near each end 200*a* and 200*b* of the heater 200 to maintain spacing between the flat ceramic plates 210 allowing fluid to flow between adjacent flat ceramic plates.

In all the examples shown, a three dimensional heater has been produced using a two dimensional heating element 88.

The examples of heaters having fins 84, 60 as a heat sink have an added benefit that the fins are used to dissipate heat from the heating element 88 and as they follow the curve of the heater 80, 50, 180 the fins 84, 60 assist in turning flow around the curve, reducing turbulence which reduces pressure losses through the heater as the fluid is turned from a first direction 120 to a second direction 130, 140 and also reduces the production of noise.

In the example without fins, as shown in FIGS. 8*a* to 8*c*, the plurality of heater elements 210 direct the flow of fluid flowing through the heater 200 by providing a longitudinal split through the fluid flow path. In this embodiment, as there are a plurality of heating elements 210 separate fins are not required for heat dissipation as instead of the heating element 80 having two surfaces available for thermal exchange with the fluid flow path, there are instead two times as many surfaces as there are heating elements 210. As shown in FIGS. 11*a* and 11*b*, thermal exchange from the heater to fluid flowing in the fluid flow path can be achieved by increasing the available surface of the heating element (FIG. 11*b*) or by providing a cooling feature such as the fins (FIG. 11*a*) which wick heat from the heating element towards the tips of the fins due to a thermal gradient, this heat is then exchanged with fluid that flows passed the fins which increases the thermal gradient causing more heat to be drawn along the fins.

The stacked heater, having a plurality of discrete ceramic heater plates 210 offers a more direct route for heat generation and transport i.e. heat is dissipated where it is generated. The fins and heating elements are one and the same. If the heating elements are thought of as heatsink fins, a very high fin efficiency can be achieved.

The name 'stacked heater' comes from the 'stack' of planar heating elements used. These can be made from: LTCC or HTCC thick-film ceramic substrate (aluminium nitride or other ceramics) which can have embedded of surface mounted (and glazed) conductive tracks; or thick-film metal substrate (these usually have a glazing to electrically insulate trace); or from an electroceramic material (e.g. doped-BaTi 'PTC')

Figure 9A:
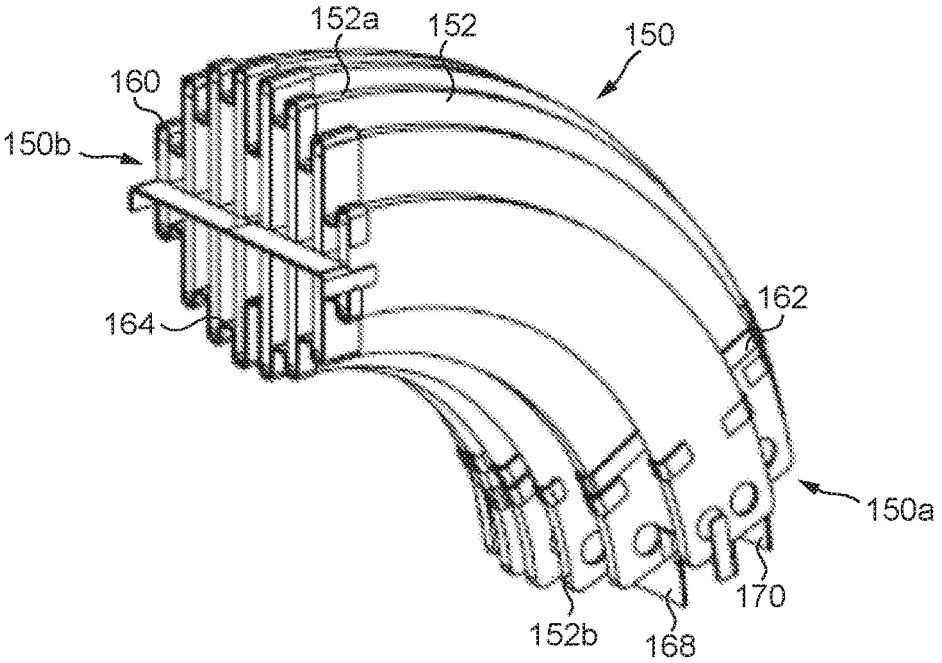
FIG. 9*a* shows an alternative stacked heater.
Figure 9B:
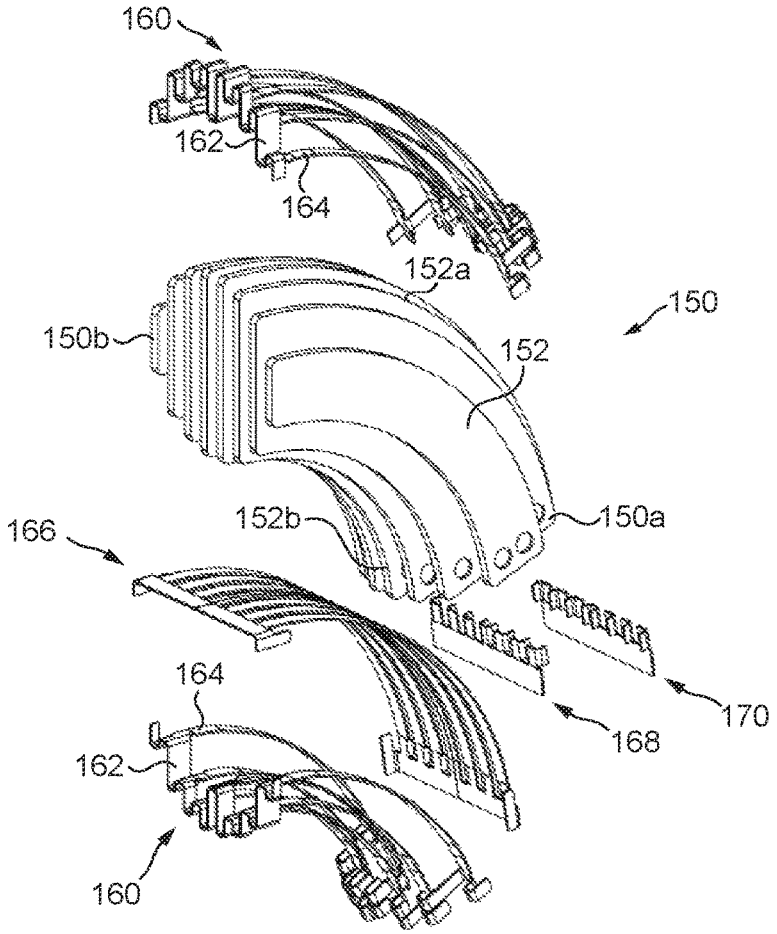
FIG. 9*b* shows an exploded view of the heater of FIG. 9*a;*

An alternative stacked heater 150 is shown in FIGS. 9*a* and 9*b*. In this embodiment, the plurality of heater elements 152 are held in position by a framework 160 which includes both retaining brackets 162 and guide vanes 164. These can be formed from a single sheet of stamped metal, or the guide vanes 164 are made separately and attached to the brackets 162.

The heater 150, generates heat in a multiple planar surfaces and is able to convect this heat directly to air heating elements so also acts as the fins of a heatsink. Air is guided along the surfaces of heating elements 152 using guide vanes 164.

A set of brackets and also at each end 150*a* and 150*b* of the heating elements 150. The guide vanes 164 extend between a pair of adjacent heating elements 150 from a first end 150*a* to the second end 150*b* and guide air flowing around the curve of the heater 150. This reduces pressure losses through the appliance and reduces the production of noise by providing a curved surface for the air to flow round and as the guide vanes are metal, they assist in transferring heat.

In addition, a central support 166 is provided. In this embodiment, the central support 166 also functions as a first neutral connection for the heating plates 152. A second neutral connector 168 and a live connector 170 are provided adjacent the first end 150*a* of the heater 150. Is this embodiment, these connectors are formed from stamped metal parts which are folded around each one of the heating elements 152 and electrically connected to the conductive track in each of the heating elements 152. The manner of electrical connection will not be discussed in detail, as the skilled person will be aware of a number of alternatives such as using vias through each one of the heating elements 152.

The guide vanes 164 are in contact with heating elements 150 through pressed contact so may heat up and dissipate this heat to air. This thermal function is not strictly needed, but is a beneficial consequence of the contact between guide vane and heating element.

Figure 9C:
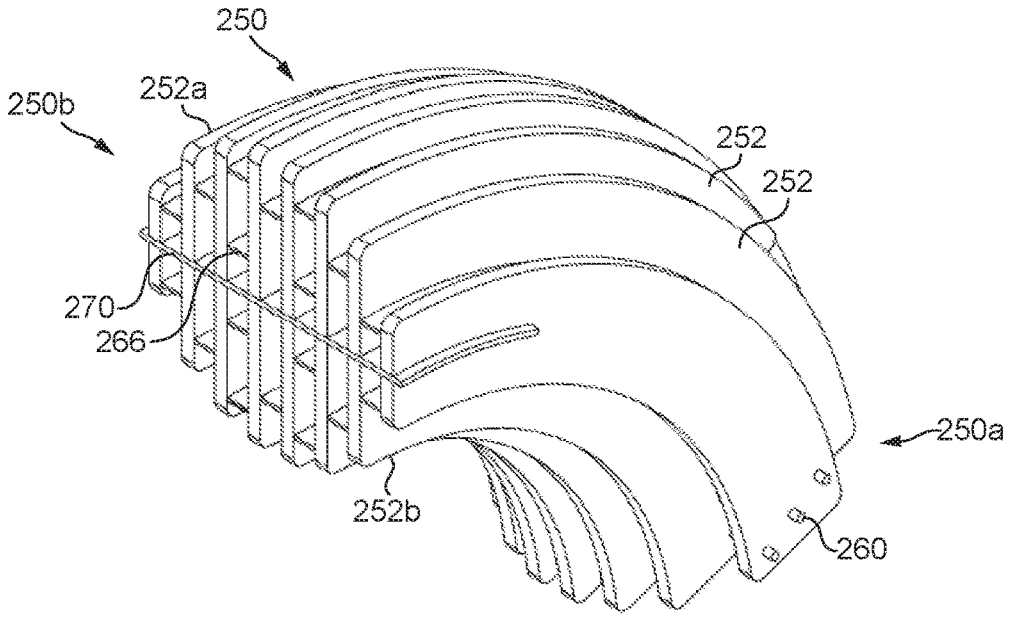
FIG. 9*c* shows isometrically a third alternative stacked heater.

A further alternative stacked heater 250 is shown in FIGS. 9*c* and 9*d*. At a first end 250*a*, which in this embodiment is the inlet end of the heater 250 i.e. where flow enters the heater 250 the electrical connectors 260 serve a secondary function. The heater 250 comprises a number of spaced apart heater elements 252 which are formed from a number of layers of tape cast ceramic with either a surface mounted conductive track which is covered by a protective glaze or an embedded conductive track where there are layers of tape cast ceramic material on either wide of the conductive track embedding the conductive track within the ceramic material.

The electrical connectors 260 are rods of conductive material and they pass through the heater elements 252 electrically connecting them but also aligning and spacing the heater elements 252.

At the second end 250*b* of the heater, which is the outlet end of the heater 250 i.e. where flow exits the heater 250, a central bar 270 is provided. The central bar 270 extends across the heater 250 and each of the heater elements 252 is provided with a notch 254 which the central bar engages. This aligns and spaces the heater elements 252 at the second end 250*b*.

An arrangement of guide vanes 264 are provided between the heating elements 252 in the heater 250. The guide vanes 264 extend between a pair of adjacent heating elements 252 from a first end 250*a* to the second end 250*b* of the heater 250 and guide air flowing around the curve of the heater 250. In this embodiment a guide vane 264 is provided adjacent each edge 252*a* and 252*b* of the heating elements 252 and in the case of the central longer heating elements 254 a further pair of guide vanes 266 are provided between the central bar 270 and the guide vanes 264. This is to assist in turning the flow in a more even fashion within the larger gap between the central bar 270 and the guide vane 264.

As the Stacked Heater is a collection of heating elements which are electrical resistors, they can be wired in different ways to achieve the desired total electrical resistance.

Figure 12A:
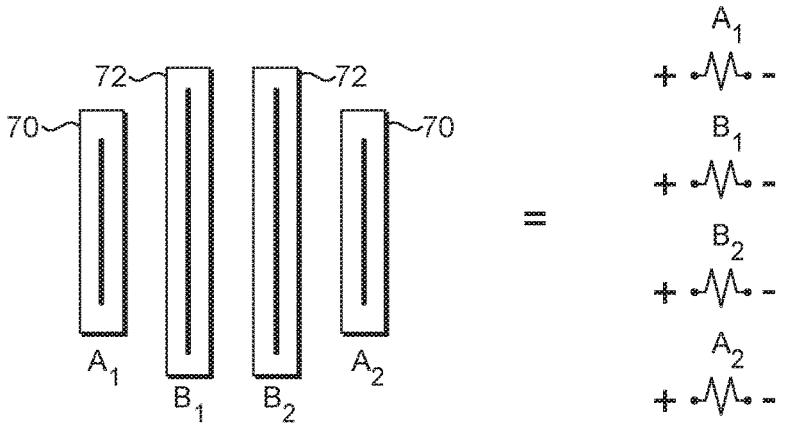
FIG. 12*a* shows an example of a mirrored heater according to aspects of the invention.

In practice, manufacturing economy of scale would dictate a mirrored design e.g. an even number of identical heaters. Referring to FIG. 12*a*, shows two small 70 and two large 72 heaters in a mirrored arrangement.

Figure 12B:
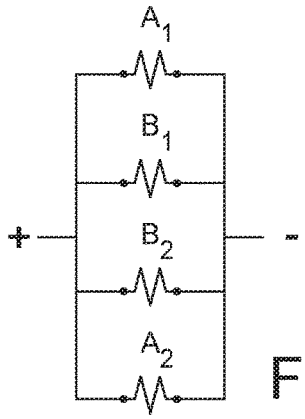
FIGS. 12*b*, 12*c* and 12*d* show different ways the heater of FIG. 12*a* can be electrically connected.
Figure 12C:
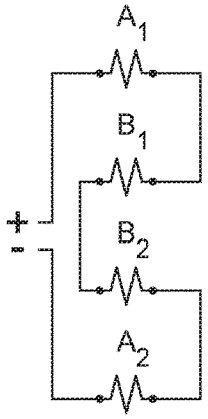
Figure 12D:
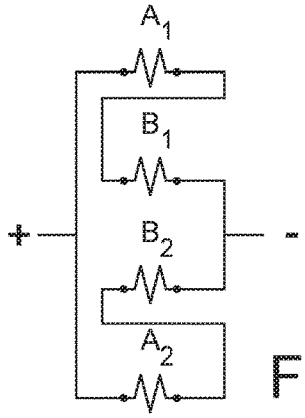

There are multiple ways to connect these separate heating elements e.g. fully parallel as shown in FIG. 12*b* (lowest total resistance), fully series as shown in FIG. 12*c* (highest total resistance) or a hybrid as shown in FIG. 12*d*. The manner in which the heating elements are connected depends on the required outputs from the heater and the system limitations.

Figure 13:
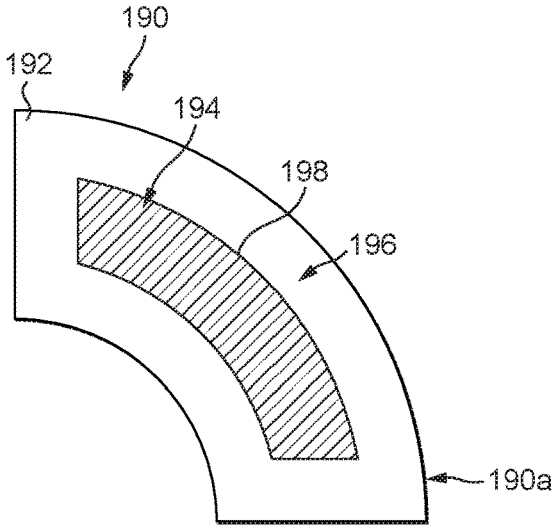
FIG. 13 shows an example of a heater element.

FIG. 13 shows an example of a heater element 190 for use in a stacked configuration (as described with respect to FIGS. 8*a* to 9*d*). The heater element 190 has a substrate 192 which is the ceramic material and a conductive track 194. The region 198 containing the conductive track 194 can be considered to be a high power zone and is the hottest part of the heater element 190 where power is input into the heater element. The outer region 196 which is devoid of the conductive track can be considered a low power zone and is cooler as it dissipates heat from the high power zone 196.

The relative proportions of the high power zone 196 and the low power zone 198 can be tuned to obtain a desired temperature at the edge 190*a* of the heater element 190. This affects the touch temperature of a surrounding housing (not shown). For a relatively small high power zone 198 within a heater element 190, the temperature gradient across the surface of the heater element 190 will be greater and so will require a better quality of ceramic substrate to withstand this. Conversely, if a lower power heater element is acceptable, a lower quality ceramic substrate can be used with a relatively larger high power zone i.e. the conductive track 194 is closer to the edge 190*a* of the heater element 190.

The air temperature cross-sectional profile at the exit as well as the temperature of the heater where it interfaces with a bounding enclosure may be controlled by appropriate design of the trace pattern e.g. edges of each heater can be made cooler so that the thermal boundary condition with the enclosure is less severe (product touch temperature requirement), the maximum achieve temperature and temperature gradient of each heating element can be kept below the maximum allowable for survivability.

Figure 15A:
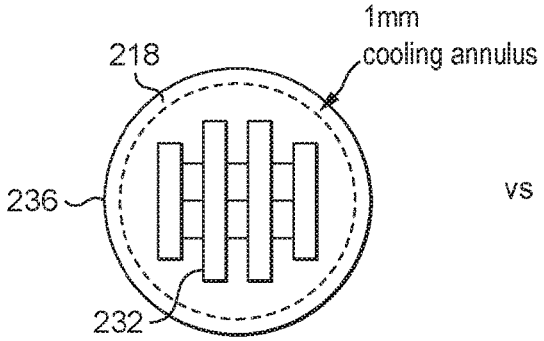
FIGS. 15*a* to 15*d* show different shapes and configurations of a heater according to aspects of the invention can take.
Figure 15B:
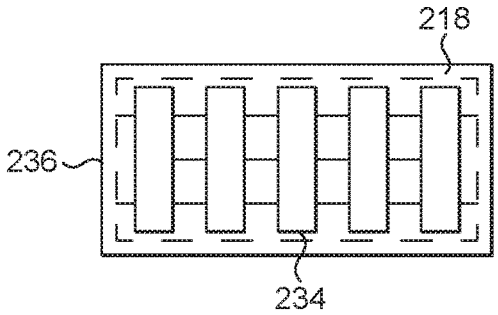
Figure 15C:
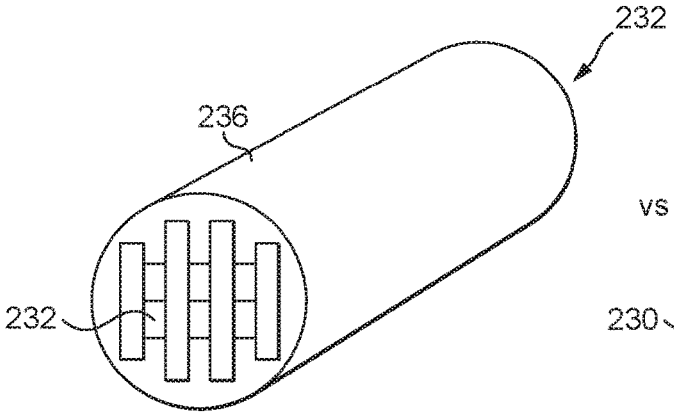
Figure 15D:
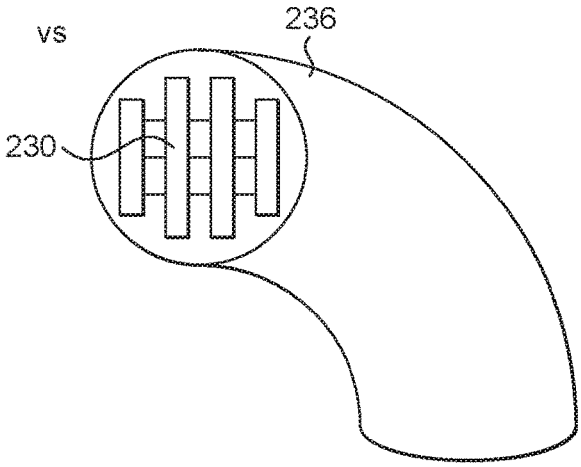

FIGS. 15*a* to 15*d* show alternative configurations that can be achieved using the stacked heater. The heaters shown in FIGS. 8*a* to 9*d* are curved or arcuate 230 as depicted in FIG. 15*d*. The stacked heaters, and indeed all of the heaters hereinbefore described can be made in other configurations such as cylindrical 232 as depicted in FIGS. 15*c* and 15*a* or quadrilateral 234 as shown in FIG. 15*b*. In all the examples, the heater 230, 232, 234 is housed within a housing 236. The housing 236 surrounds and contains the heater 230, 232, 234 providing protection to the heater and a thermal barrier. In an appliance 10, the housing 236 sits within an outer casing 18 of the appliance 10 often with a small air gap 118 between the housing and the outer casing 18 and another air gap 218 between the housing 236 and the heater 230, 232, 234. The air gaps 118, 218 provide thermal insulation for the heater 230, 232, 234 enabling the outer casing 18 of the appliance to be handled by a user.

Figure 14A:
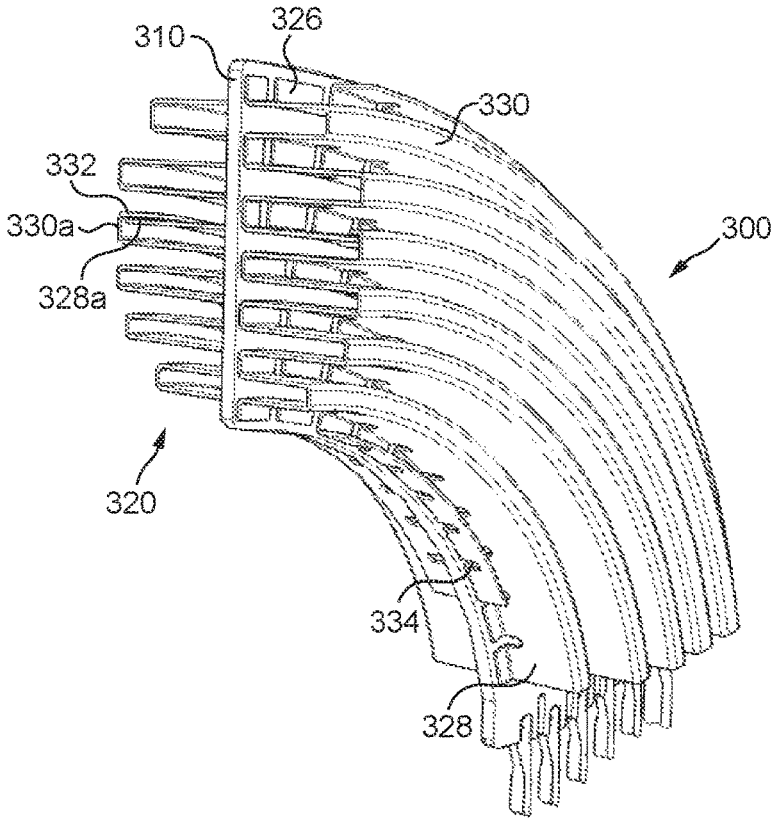
FIGS. 14*a* to 14*c* show an alternative heater according to aspects of the invention.
Figure 14B:
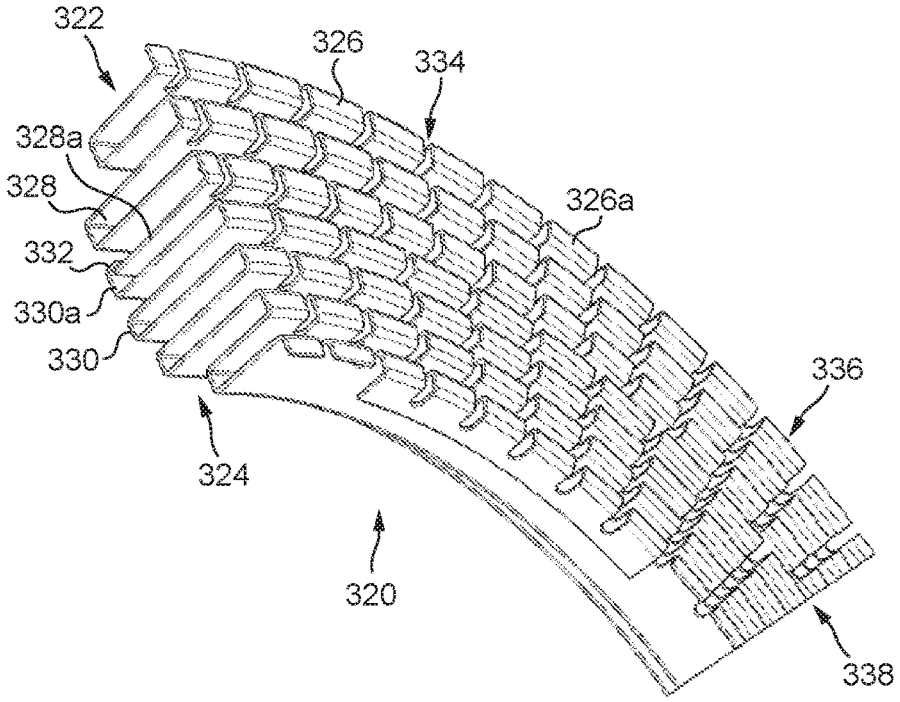
Figure 14C:
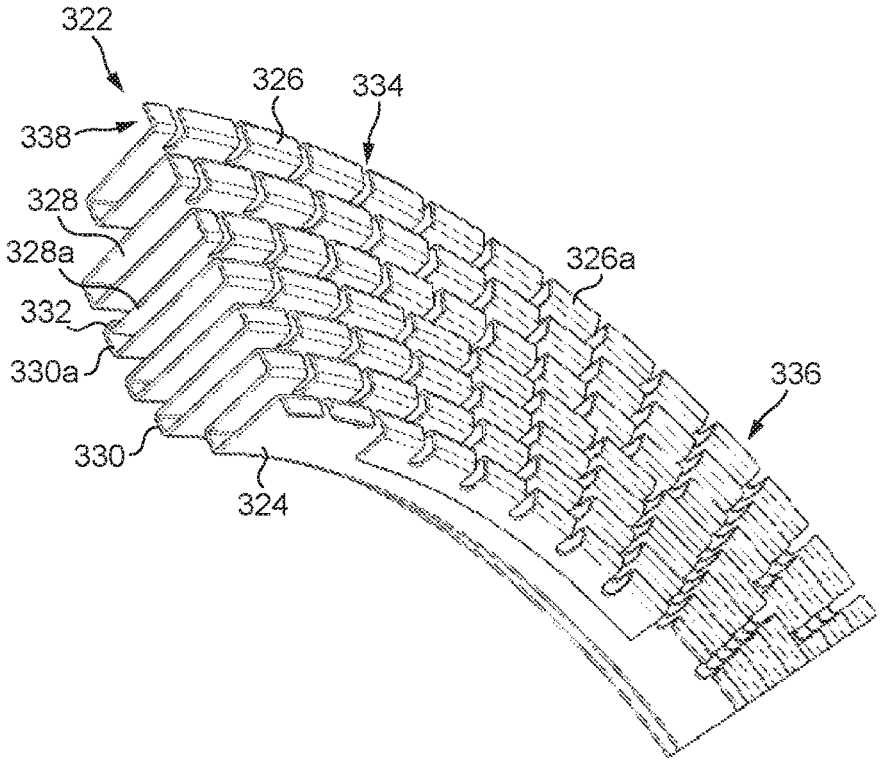

FIGS. 14*a* and 14*b* show an alternative heater 300 having flat ceramic plate 310 with an embedded conductive track as previously described (not shown). In this embodiment, there are two heat sinks 320, one either side of the flat ceramic plate 310. The heat sinks 320 are made from a conductive material such as aluminium, copper, titanium or a non-expansion alloy such as Kovar and are formed from stamped sheets. Each one of the two heat sinks 320 is formed from a first part 322 and a second part 324 both of which are formed as corrugated or castellated parts. There is a foot section 326 for connecting to the flat ceramic plate 310, a leg section 328 which extends from the foot section 326 generally orthogonal to the flat ceramic plate 310 and forms the majority of the heat sink area and a connecting section 330 which extends between adjacent leg section distal to the foot section 326.

At the interface between the first part 322 and the second part 324 of a heat sink, in order to maintain even spacing between the first part and the second part, the first part 332 ends with a leg 328*a* without a connecting section and the second part 326 ends with a connecting portion 330*a* which is provided with a lip 332 which is adapted to extend over leg 328*a*.

With the previous embodiments described, the heat sinks have been formed from individual fins which were attached to or embedded into the flat ceramic plate. In contrast, in this embodiment, a number of fins are formed from each of the first part 322 and the second part 324 which are subsequently attached to each surface of the flat ceramic plate 310. In this embodiment, the heat sinks have a thermal mismatch to the ceramic material so the joint between the heat sink and the flat ceramic plate 310 is non-continuous. The foot section 326, is not a continuous piece of material rather, it is formed from a plurality of individual connectors 326*a* with an expansion gap 334 inbetween each adjacent connector. The expansion gap 334 relieves stress created between the heat sink and the flat ceramic plate 310 during thermal cycling due to the heat sink material expanding and contracting more that the ceramic material.

The heat sinks can be attached to the flat ceramic plate 310 by a number of different methods. A bonding paste, glue, thermal paste, glaze could be used but these methods have temperature limitations of around 2-300° C. so cannot be used for a heater which is intended to run at higher temperatures such as around 600° C. For a higher operating temperature, brazing of the heat sink onto the flat ceramic plate is an option as is ultrasonically welding the heat sink.

Ultrasonic welding is an established joining technique and can be used for any of the heaters herein described where the heat sink is bonded or glued to the heating element. For the example shown in FIGS. 14*a* and 14*b*, the individual connectors 326*a* may be ultrasonically welded to the flat ceramic plate 310. As with brazing, for ultrasonic welding, the flat ceramic plate first requires metallizing to enable metal heat sinks to bond to the ceramic. The outer surface of the flat ceramic plate is coated with a metallisation paste which typically includes the ceramic material used to form the flat ceramic plate, a refractory material such as tungsten plus binders and fillers.

In the welding process, the heat sink 320 and the flat ceramic plate 310 are positioned in a rig or anvil and a welding tool (sonotrode) is placed against an individual connector 320*a* with a small force whilst the ultrasonic frequency is applied and the weld formed. Typically a frequency of 20 kHz is used, for a connector size of 3 mm and heat sink thickness of 0.3 mm around 200N of force is used during the welding process and the welding process takes around 60 microseconds. A single weld can join more than one of the individual connectors 326*a* such as a row of connectors, 336 a column of connectors 338 or an array of connectors.

Figure 14D:
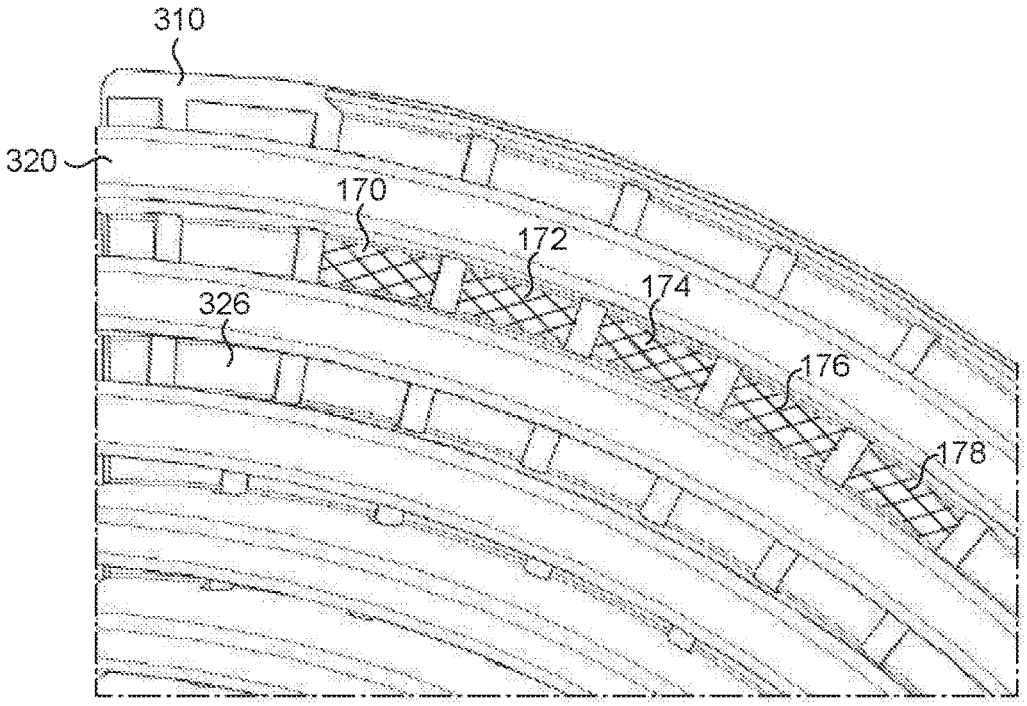
FIG. 14*d* shows a partially welded heat sink.

Referring to FIG. 14*d*, in one embodiment, a number of individual connectors 170, 172, 174, 176, 178 are welded in a single process. The sonotrode is designed to cover all five of the individual connectors 170, 172, 174, 176, 178 in a single cycle, the sonotrode is moved to the next set and the process is repeated until all of the individual connectors 326 have been welded to the flat ceramic plate 310. In this example the individual connectors are 1.7 mm by 0.7 mm although this is merely convenient for this particular heater, larger or smaller individual connectors may be used however, for the stress relief to function they connectors cannot be too large.

The ultrasonic process leaves a surface pattern on the connectors 170, 172, 174, 176, 178 which in this example is a cross-hatch. The person skilled in the art will appreciate that other patterns are suitable, the main objective, according to various aspects, is to achieve the required strength to enable the joints to withstand a lifetime of thermal cycling as the heater is heated and cooled during use.

In order to enable any angle of exit from the fluid outlet, the appliance is provided with a housing that extends beyond the heater. In FIG. 2, this piece of the housing 16 is straight and fluid flowing out of the heater 80 continues in the same direction. However, this piece of the housing does not need to be straight it could be curved to allow exit from a different angle or even be adjustable by a user to enable a range of different exit angles to be used.

The conductive track can be formed from two tracks as described, however one track can be used or more than two. Use of a single track may limit the temperatures setting available to the user whereas multiple tracks enable different wattage to be turned on and off giving more levels of temperature and more accurate control. Different wattage can be achieved by a number of different identical tracks or each track could be rated to a different number of watts. Also, although three connection points are shown, each track could have individual connection points or a different sharing arrangement could be used.

Suitable ceramic materials include aluminium nitride, aluminium oxide and silicon nitride.

According to various aspects, an appliance has been described as having a fluid flow and this has been used instead of air flow as it is known to use hair care appliances with refillable containers of serums or even water to hydrate hair as it is being styled. Indeed it may utilise a different combination of gases or gas and can include additives to improve performance of the appliance or the impact the appliance has on an object the output is directed at for example, hair and the styling of that hair.

Various aspects have been described in detail with respect to a hairdryer however, it is applicable to any appliance that draws in a fluid and directs the outflow of that fluid from the appliance.

According to various aspects, the appliance can be used with or without a heater; the action of the outflow of fluid at high velocity has a drying effect.

According to various aspects, the appliance has been described without discussion of any attachment such as a concentrating nozzle or a diffuser however, it would be feasible to use one of these known types of attachment in order to focus the exiting fluid or direct the fluid flow differently to how it exits the appliance without any such attachment.

The invention is not limited to the detailed description given above. Variations will be apparent to the person skilled in the art.

The invention claimed is:

1. A heater comprising a ceramic heater element and ceramic heat sink, wherein the ceramic heater element and the ceramic heat sink are both formed from a plurality of layers of tape cast ceramic material; wherein the layers of the ceramic heater element are parallel to a first plane, the layers of the ceramic heat sink are parallel to a second plane, and the first plane is orthogonal to the second plane.

2. The heater of claim 1, wherein the ceramic heater element is planar and extends within the first plane.

3. The heater of claim 2, wherein the ceramic heat sink extends in the second plane.

4. The heater of claim 1, wherein the ceramic heat sink comprises a plurality of fins.

5. The heater of claim 4, wherein each one of the plurality of fins is discrete.

6. The heater of claim 1, wherein the ceramic heater element comprises a conductive track.

7. The heater of claim 6, wherein the conductive track is surface mounted to a distal side of the ceramic heater element than the ceramic heat sink.

8. The heater of claim 7, wherein the conductive track is coated with an insulating material.

9. The heater of claim 7, wherein the conductive track is embedded within the ceramic heater element.

10. The heater of claim 1, wherein the ceramic heat sink is bonded to a surface of the ceramic heater element.

11. The heater of claim 1, wherein the ceramic heater element is curved, arcuate or quadrilateral.

12. The heater of claim 11, wherein the ceramic heater is curved or arcuate and the ceramic heat sink follows a same arc as the ceramic heater element.

13. A hand held appliance comprising a heater comprising a ceramic heater element and ceramic heat sink, wherein the ceramic heater element and the ceramic heat sink are both formed from a plurality of layers of tape cast ceramic material; wherein the layers of the ceramic heater element are parallel to a first plane, the layers of the ceramic heat sink are parallel to a second plane, and the first plane is orthogonal to the second plane.

14. The appliance of claim 13, wherein the appliance is a hair care appliance.

15. The appliance of claim 14, wherein the hair care appliance is a hairdryer.

* * * * *